US011738830B2

(12) United States Patent
Hao et al.

(10) Patent No.: US 11,738,830 B2
(45) Date of Patent: Aug. 29, 2023

(54) AUTOMATIC FALLING-OFF DEVICE FOR SELF-SINKING AND FLOATING TYPE PROFILING FLOAT DIVERSION SHELL AND DIVERSION SHELL

(71) Applicant: INSTITUTE OF OCEANOGRAPHIC INSTRUMENTATION, SHANDONG ACADEMY OF SCIENCES, Qingdao (CN)

(72) Inventors: Zongrui Hao, Qingdao (CN); Lu Dong, Qingdao (CN); Wanlong Ren, Qingdao (CN); Yue Wang, Qingdao (CN); Gang Liu, Qingdao (CN); Zhili Hua, Qingdao (CN); Juan Xu, Qingdao (CN)

(73) Assignee: INSTITUTE OF OCEANOGRAPHIC INSTRUMENTATION, SHANDONG ACADEMY OF SCIENCES, Qingdao (CN)

( * ) Notice: Subject to any disclaimer, the term of this patent is extended or adjusted under 35 U.S.C. 154(b) by 0 days.

(21) Appl. No.: 18/107,533

(22) Filed: Feb. 9, 2023

(65) Prior Publication Data

US 2023/0182869 A1 Jun. 15, 2023

(30) Foreign Application Priority Data

May 16, 2022 (CN) ..... 202210525380.5

(51) Int. Cl.

| | |
|---|---|
| ***B63B 22/08*** | (2006.01) |
| ***B63B 22/00*** | (2006.01) |
| ***B63B 22/14*** | (2006.01) |

(52) U.S. Cl.

CPC ..... *B63B 22/08* (2013.01); *B63B 22/00* (2013.01); *B63B 22/14* (2013.01)

(58) Field of Classification Search

CPC ..... B63B 22/00; B63B 22/003; B63B 22/04; B63B 22/08; B63B 22/14

See application file for complete search history.

(56) References Cited

U.S. PATENT DOCUMENTS 3,059,254 A * 10/1962 Dillistone ..... B63B 22/14 441/10

4,118,060 A * 10/1978 Brown ..... B66C 1/34 294/82.3

(Continued)

*Primary Examiner* — Ajay Vasudeva

(74) *Attorney, Agent, or Firm* — Richard Gerald Topolewski

(57) ABSTRACT

The present invention relates to an automatic falling-off device for a self-sinking and floating type profiling float diversion shell and the diversion shell. An automatic falling-off device for a self-sinking and floating type profiling float diversion shell, comprises a locking device and an unhooking device; the locking device comprises a locking hook plate and a locking core plate; the locking hook plate is provided on one half diversion shell, and the locking core plate is fixed on another half diversion shell; a locking hook at a front end of the locking hook plate fits with a locking ring at a front end of the locking core plate for locking; the unhooking device comprises a base and a buoyancy airbag; and the base is provided below the locking hook plate, and the buoyancy airbag is mounted between the base and the locking hook plate.

4 Claims, 9 Drawing Sheets

(56) References Cited

U.S. PATENT DOCUMENTS

| | | | | |
|---|---|---|---|---|
| 4,136,415 | A * | 1/1979 | Blockburger | B63B 22/08 367/133 |
| 4,654,832 | A * | 3/1987 | Barker | B64D 17/38 367/4 |
| 4,834,684 | A * | 5/1989 | Tallerino | B63B 22/08 441/2 |
| 8,047,590 | B1 * | 11/2011 | Hamme | B66C 1/66 294/66.1 |
| 9,206,903 | B2 * | 12/2015 | Huard | F16J 15/164 |
| 9,254,892 | B2 * | 2/2016 | Hatakeyama | G01V 1/18 |
| 10,946,937 | B2 * | 3/2021 | Gug | B63B 22/08 |
| 2006/0191403 | A1 | 8/2006 | Hawkins et al. | |
| 2010/0008219 | A1 | 1/2010 | Chen | |
| 2014/0237707 | A1 | 8/2014 | Lane | |

* cited by examiner

AUTOMATIC FALLING-OFF DEVICE FOR SELF-SINKING AND FLOATING TYPE PROFILING FLOAT DIVERSION SHELL AND DIVERSION SHELL

TECHNICAL FIELD

The present invention relates to the technical field of marine environment monitoring, and specifically to an automatic falling-off device for a self-sinking and floating type profiling float diversion shell and the diversion shell.

BACKGROUND

A self-sinking and floating type profiling float is an ocean observation platform, and firstly used in the international Argo program, so it is called Argo float, and is specially used for ocean subsurface temperature, salt and depth profiling. After deployment, the float can work in the sea for more than two years by itself until the power supply is exhausted. The ocean observation data obtained by Argo are conducive to climate and natural disaster prediction, and help to understand processes of ocean interior changes.

At present, the Argo floats are usually deployed by ships, and the deployment area is limited. It is difficult to deploy such floats in areas that are difficult for the ships to reach. In order to deploy the floats smoothly, a diversion shell is usually required to be additionally provided on the float to obtain a low-resistance streamline, to meet underwater delivery, and to deploy the float to the area which is difficult to reach by the ship. The diversion shell is generally composed of two symmetrical shell portions, and the two shell portions are assembled into a complete diversion shell to wrap the float therein.

However, after the delivery process, the low-resistance streamline of the float is not easy to float and submerge, which affects acquisition of observation data, and the diversion shell needs to be removed. It is difficult and time-consuming to remove the underwater float diversion shell manually Therefore, it is necessary to develop an automatic falling-off device to meet the automatic falling-off requirement of the underwater ARGO float diversion shell.

SUMMARY

In order to solve the technical problem that a self-sinking and floating type profiling float diversion shell cannot fall off automatically at the present stage, an automatic falling-off device for a self-sinking and floating type profiling float diversion shell is provided. Through pressure change inside and outside an airbag, the automatic falling-off device on the float diversion shell is started to open a locking hook, so that the diversion shell disengages and falls off.

The technical scheme adopted by the present invention to solve the mentioned-above technical problem is as follows: an automatic falling-off device for a self-sinking and floating type profiling float diversion shell, comprises a locking device and an unhooking device; the locking device comprises a locking hook plate and a locking core plate; where the locking hook plate is provided on one half diversion shell, and the locking core plate is fixed on another half diversion shell; a locking hook at a front end of the locking hook plate fits with a locking ring at a front end of the locking core plate for locking; the unhooking device comprises a base and a buoyancy airbag; the base is provided below the locking hook plate, and the buoyancy airbag is mounted between the base and the locking hook plate; and when the buoyancy airbag is inflated, the locking hook plate is driven to move upwards to release the locking core plate, so that the diversion shell disengages and falls off.

Preferably, a front end of the base is provided with a locking hook groove in fit with the locking hook of the locking hook plate.

Further preferably, a limiting airbag is provided on the base; positioning grooves are provided on both sides of the locking hook plate; the limiting airbag fits with the positioning grooves, and when the limiting airbag is inflated, the locking hook plate is limited to maintain a locked state thereof.

Further preferably, a limit spring is provided between the base and the locking hook plate.

Further preferably, a return spring is provided on the base, an inner end of the return spring is fixed, and an outer end thereof is connected to a flapper.

The present invention also provides a diversion shell, the diversion shell is composed of two symmetrical half shells, and the automatic falling-off device is provided at a connection position of the half shells.

According to the present invention, the float can be smoothly deployed to an area difficult to reach by a ship due to changes of internal pressure and external pressure of the airbag at different water depths, and the diversion shell can automatically disengage and fall off after the deployment is completed, without affecting profiling by the self-sinking and floating type profiling float.

BRIEF DESCRIPTION OF THE DRAWINGS

FIG. 13(*b*) is a force analysis diagram of the locking hook plate at a second stage in the operating principle of the automatic falling-off device for the self-sinking and floating type profiling float diversion shell according to an embodiment of the present invention; and FIG. 13(*c*) is a force analysis diagram of the locking hook plate at a third stage in the operating principle of the automatic falling-off device for the self-sinking and floating type profiling float diversion shell according to an embodiment of the present invention.

Figure 1:
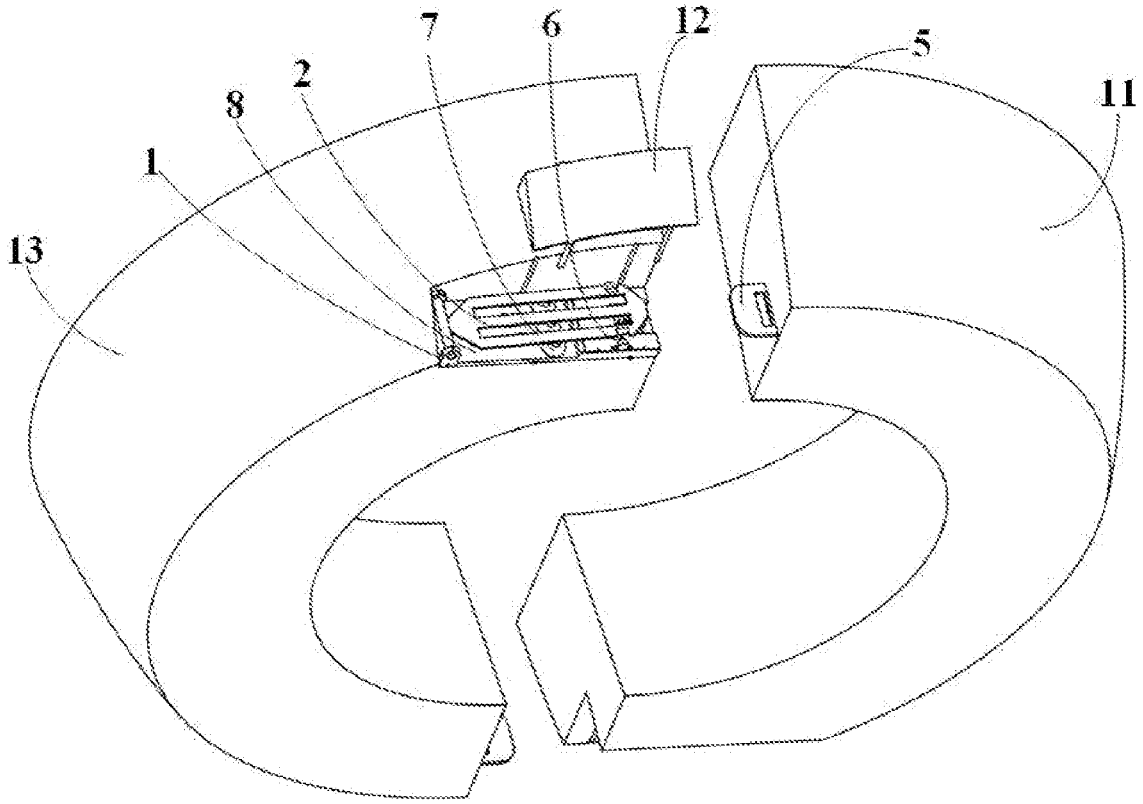
FIG. 1 is a mounting diagram of an automatic falling-off device for a self-sinking and floating type profiling float diversion shell and the diversion shell according to an embodiment of the present invention.

Reference numerals in the drawings are as follows: 1: mounting seat; 2: locking hook plate; 3: limit spring; 4: return spring; 5: locking core plate; 6: limiting airbag; 7: buoyancy airbag; 8: base; 9: flapper; 10: cover plate; 11: first half shell; 12: end cover; 13: second half shell;

1-1: fixing hole; 1-2: shaft hole;

2-1: fixing shaft; 2-2: raised structure; 2-3: support seat; 2-4: positioning groove; 2-5: locking hook;

5-1: contact end face; 5-2: locking ring;

7-1: moving end; 7-2: airbag body; 7-3: threaded structure;

8-1: positioning hole; 8-2: shell fixing seat; 8-3: limit spring seat; 8-4: locking hook groove; 8-5: flapper positioning groove; 8-6: first bolt hole; 8-7: threaded hole;

9-1: plate body; 9-2: limiting structure; 9-3: spring fixing hole;

10-1: slot; 10-2: second bolt hole;

12-1: fixing post.

DESCRIPTION OF THE EMBODIMENTS

In order to facilitate understanding of the present invention, the present invention is described in more detail below in conjunction with the accompanying drawings and specific embodiments. Preferred embodiments of the present invention are shown in the drawings. This present invention may, however, be implemented in many different forms and should not be construed as limited to the embodiments set forth herein. Rather, these embodiments are provided for the purpose of providing a more thorough and comprehensive understanding of the disclosure of the present invention.

Figure 2:
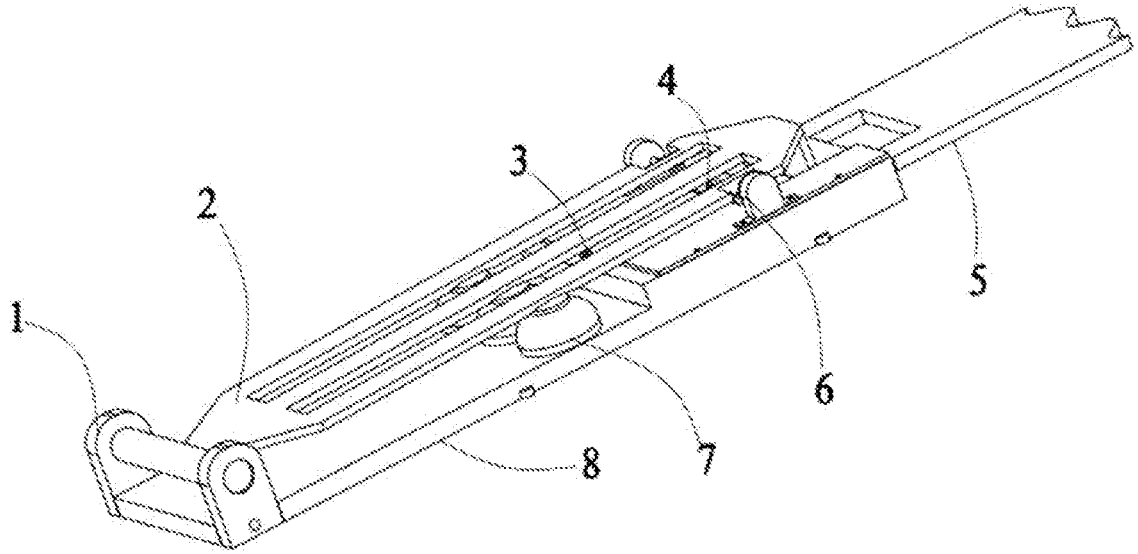
FIG. 2 is an overall structural diagram of an automatic falling-off device for a self-sinking and floating type profiling float diversion shell according to an embodiment of the present invention.

Embodiment 1. This embodiment provides an automatic falling-off device for a self-sinking and floating type profiling float diversion shell. As shown in FIGS. 1 and 2, the automatic falling-off device mainly comprises a mounting seat 1, a locking hook plate 2, a limit spring 3, a return spring 4, a locking core plate 5, a limiting airbag 6, buoyancy airbags 7, a base 8, a flapper 9 and a cover plate 10. Here, the locking core plate 5 is fixed on a first half shell 11 of the diversion shell, and the remaining structures and components except the locking core plate 5 are all provided on a second half shell 13. Contact surfaces of the first half shell 11 and the second half shell 13 are split axial sections. A front end of the locking core plate 5 protrudes from the axial section of the first half shell 11. A structure on the second half shell 13 is flush with the split axial section thereof, and the above-mentioned structural component is mounted and fixed by making a groove on an outer peripheral surface on the second half shell 13, and is then closed by an end cover 12.

Figure 3:
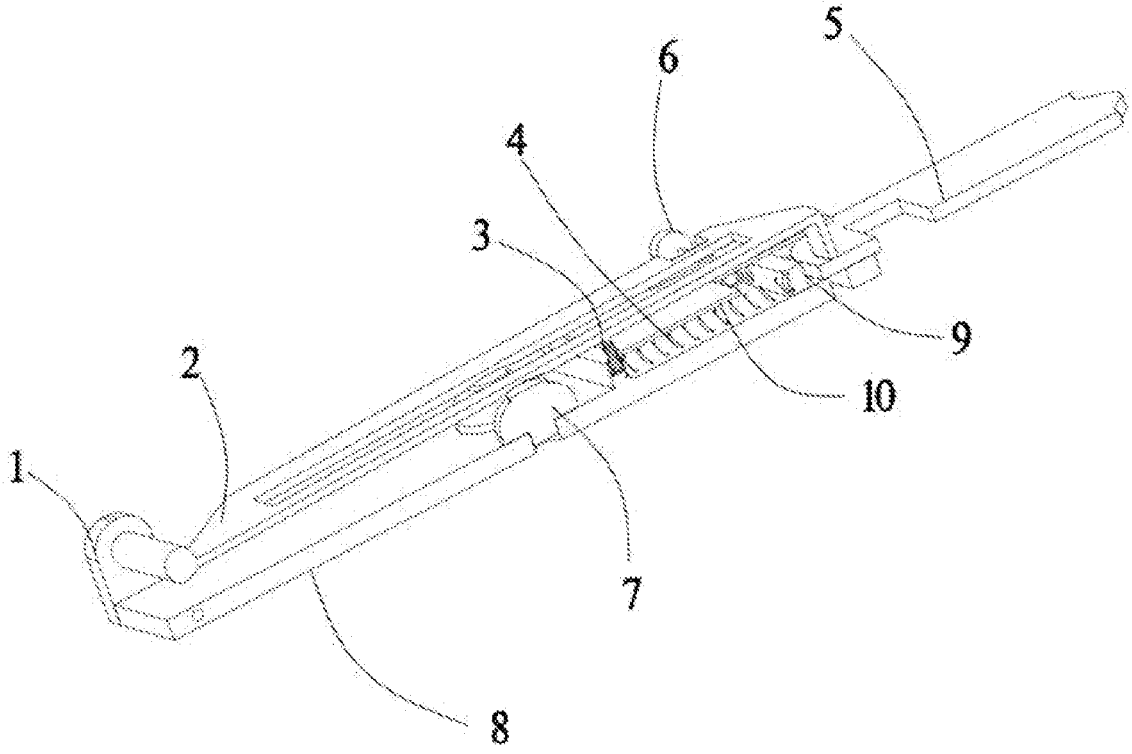
FIG. 3 is a cross-sectional view of an automatic falling-off device for a self-sinking and floating type profiling float diversion shell according to an embodiment of the present invention.
Figure 4:
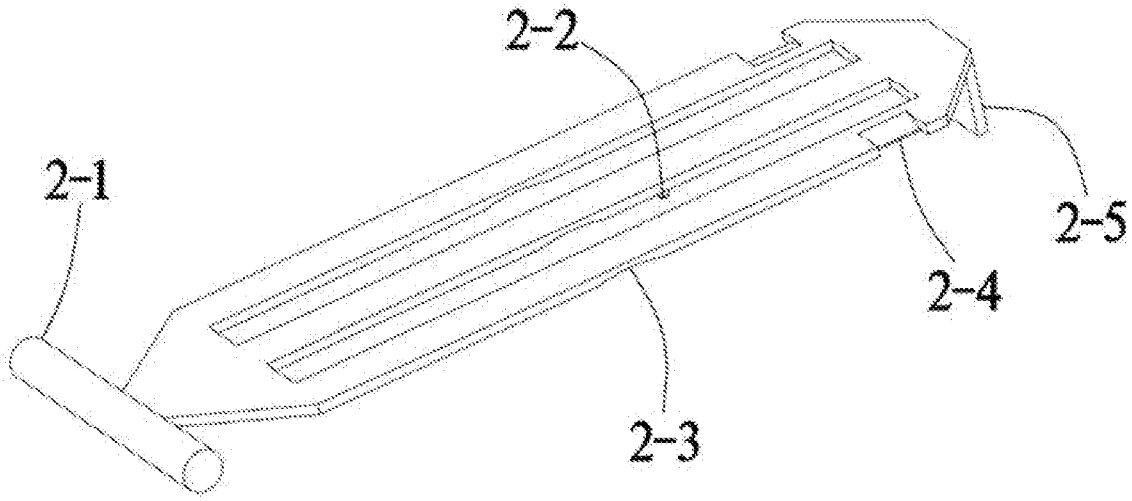
FIG. 4 is a structural diagram of a locking hook plate.
Figure 7:
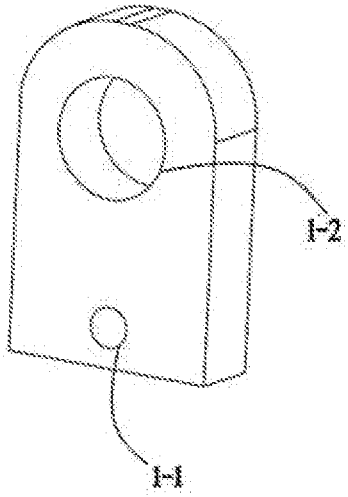
FIG. 7 is a structural diagram of a mounting seat.

As shown in FIGS. 3 and 4, the locking hook plate 2 comprises a locking hook 2-5 at a front end, a middle portion thereof is in the shape of a hollowed-out slot, and such structural form can reduce weight of the locking hook plate 2 and facilitate subsequent unhooking operation. A plurality of raised structures 2-2 are provided on a lower end face of the locking hook plate 2. The locking hook plate 2 is provided with a positioning groove 2-4 at a side position close to the locking hook 2-5, and the positioning groove fits with the limiting airbag 6. A rear end of the locking hook plate 2 is connected to a shaft hole 1-2 of the mounting seat 1 via a fixing shaft 2-1. The mounting seat 1 is structurally as shown in FIG. 7, and the mounting seat 1 fits with a positioning hole 8-1 on the base 8 via a fixing hole 1-1 to mount the locking hook plate 2 on the base 8. In other embodiments of the present invention, the locking hook plate 2 can also be mounted directly in the groove made on the second half shell 13, such as mounted in fit with the fixing shaft 2-1 by making a hole on a side wall of the groove. The locking hook plate 2 can rotate along the fixing shaft 2-1.

Figure 5:
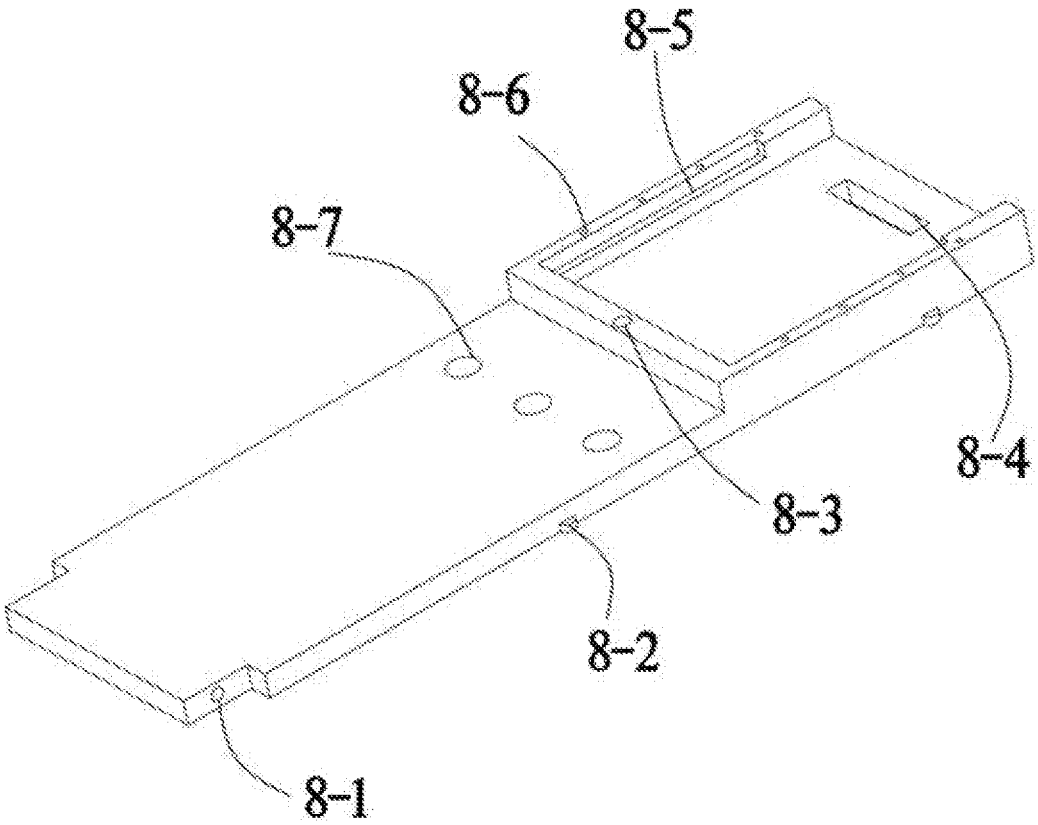
FIG. 5 is a structural diagram of a base.
Figure 10:
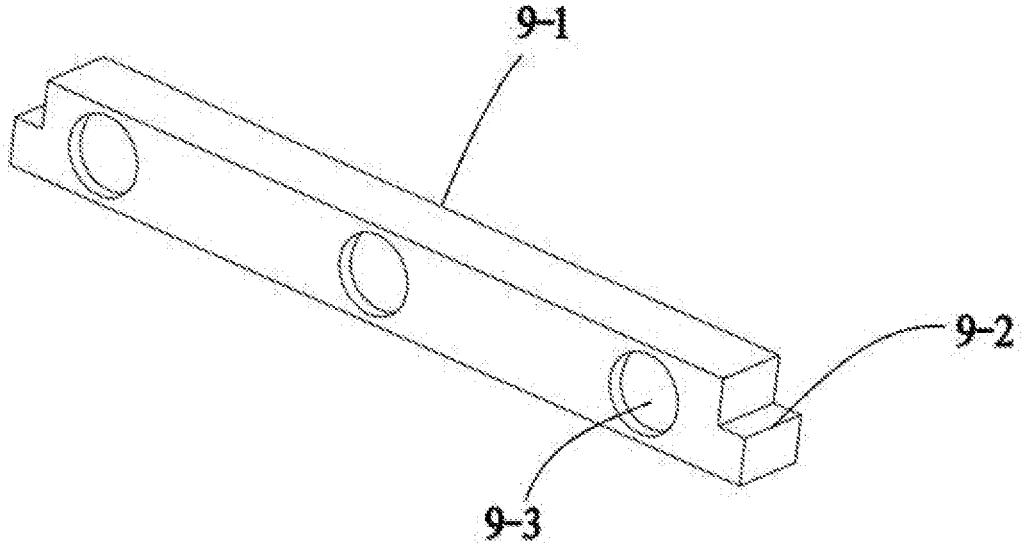
FIG. 10 is a structural diagram of a flapper.

As shown in FIG. 5, the base 8 comprises the positioning hole 8-1, a shell fixing seat 8-2, a limit spring seat 8-3, a locking hook groove 8-4, a flapper positioning groove 8-5, a first bolt hole 8-6 and a threaded hole 8-7. The base 8 is fixed on the shell of the diversion shell via the shell fixing seat 8-2. A front end of the base 8 is provided with a U-shaped groove which is surrounded by a flange protruding from an upper end face of the base 8. The limit spring seat 8-3, the flapper positioning groove 8-5 and the first bolt hole 8-6 are all provided on the flange of the U-shaped groove, and the limit spring seat 8-3 is adapted to fix the limit spring 3; the first bolt hole 8-6 is adapted to fix the cover plate 10, and the flapper positioning groove 8-5 is slidably connected with the flapper 9 and plays a guiding role for movement of the flapper 9. The flapper 9 is structurally as shown in FIG. 10, and comprises a plate body 9-1, both sides of the plate body 9-1 are respectively provided with a limiting structure 9-2, and a middle portion thereof is provided with a spring fixing hole 9-3. The limiting structures 9-2 are placed in the flapper positioning groove 8-5 of the base 8.

Figure 11:
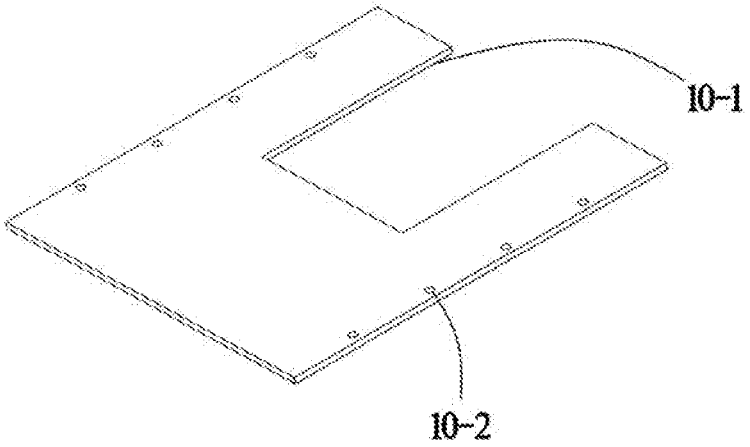
FIG. 11 is a structural diagram of a cover plate.

An upper portion of the U-shaped groove of the base 8 is provided with the cover plate 10. The cover plate is structurally as shown in FIG. 11, and comprises a slot 10-1 and a second bolt hole 10-2. The cover plate 10 is fixed via the second bolt hole 10-2 thereof and the first bolt hole 8-6 on the base 8, and limits movement of the limiting structures 9-2, so that the limiting structures move along the flapper limiting groove 8-5 without displacement in other directions. The slot 10-1 facilitates falling of the locking hook 2-5 of the locking hook plate 2, and hooks a locking ring 5-2 of the locking core plate 5 to perform locking.

The locking hook groove 8-4 is located at an inner front end of the U-shaped groove and fits with the locking hook 2-5 on the locking hook plate 2 to lock the locking core plate 2.

Figure 6:
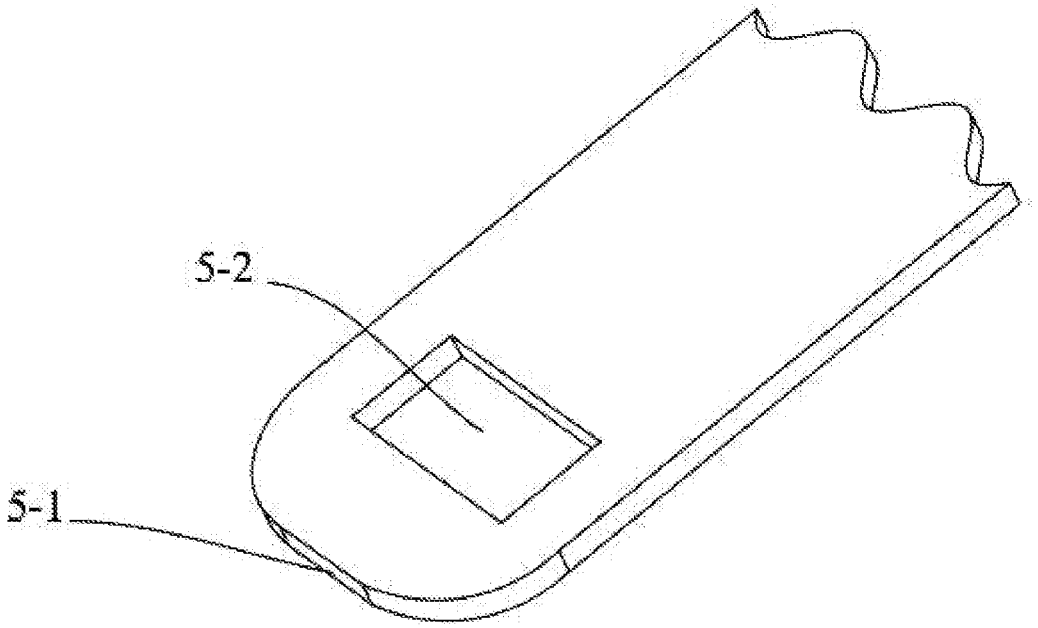
FIG. 6 is a structural diagram of a locking core plate.

As shown in FIG. 6, the front end of the locking core plate 5 is provided with a contact end face 5-1 and the locking ring 5-2, and the locking ring 5-2 fits with the locking hook 2-5 at the front end of the locking hook plate 2 and the locking hook groove 8-4 on the base 8 to lock the locking core plate 2 on the base 8, thereby assembling the first half shell 11 and the second half shell 13 into a complete diversion shell. The contact end face 5-1 is adapted to contact the flapper 9.

Figure 8:
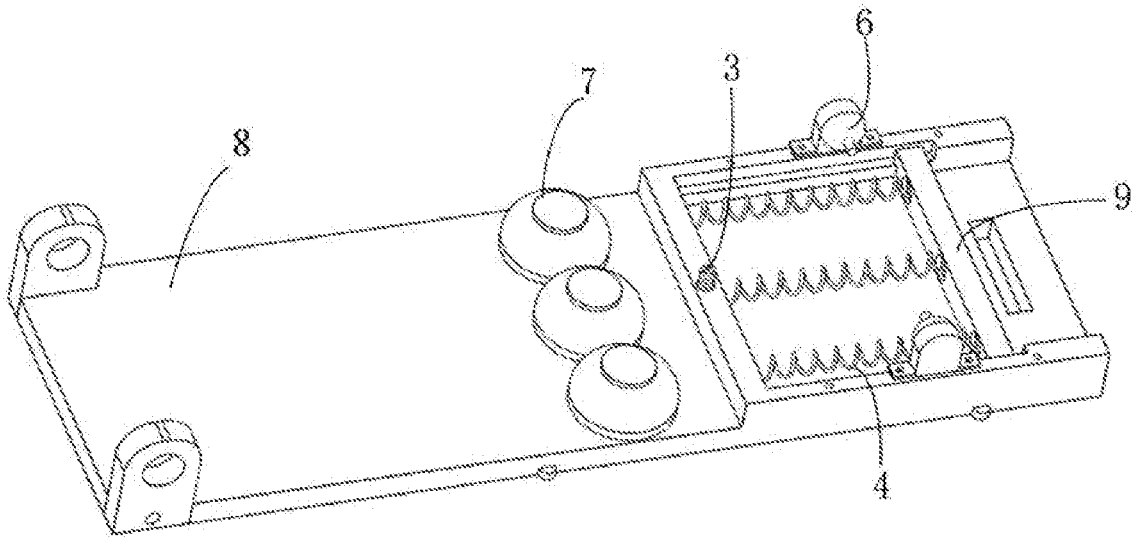
FIG. 8 is a structural diagram of an unhooking device.
Figure 9:
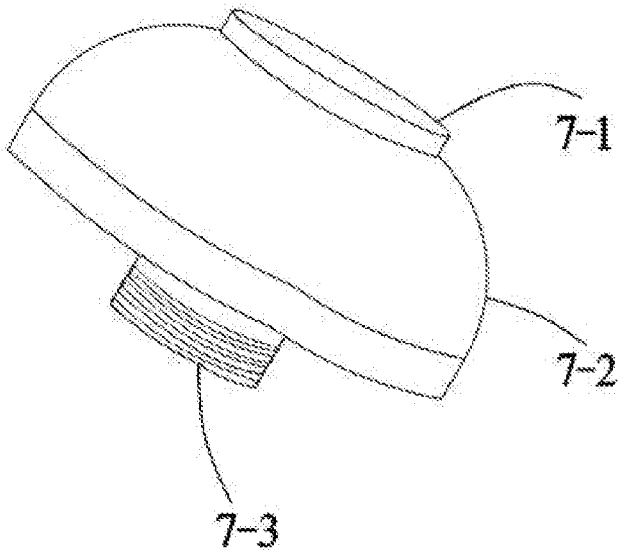
FIG. 9 is a schematic diagram of a buoyancy airbag.

As shown in FIGS. 3 and 8, the buoyancy airbags 7 are mounted between the locking hook plate 2 and the base 8, and in this embodiment, a total of 3 buoyancy airbags are provided. As shown in FIG. 9, each of the buoyancy airbags 7 comprises an airbag body 7-2, an upper end of the airbag body 7-2 is a moving end 7-1, and the moving end 7-1 fits with a support seat 2-3 on the locking hook plate 2 to support the unhooking operation of the locking hook plate 2. A threaded structure 7-3 at a bottom of the airbag body 7-2 fits with the threaded hole 8-7 on the base 8 to fix the buoyancy airbags 7.

The positioning groove 2-4 on the locking hook plate 2 fits with the limiting airbag 6. The limiting airbag 6 is fixed on the base 8 via the mounting seat, and when internal pressure of the limiting airbag 6 is greater than an external pressure, the limiting airbag is inflated in the direction of the positioning groove 2-4 to press the positioning groove 2-4, thereby limiting action of the locking hook plate 2. When the internal pressure of the limiting airbag 6 is less than the external pressure, the limiting airbag is deflated in an opposite direction, and at this time, the compression of the limiting airbag 6 on the positioning groove 2-4 disappears, releasing limiting of the locking hook plate 2 to facilitate subsequent disengaging operation. The raised structure 2-2 on the lower end face of the locking hook plate 2 fits with the limit spring seat 8-3 on the base 8 to fix the limit spring 3 between the base 8 and the locking hook plate 2.

A plurality of return springs 4 arranged in parallel are provided in the U-shaped groove of the base 8, inner ends of the return springs 4 are fixedly connected to an inner wall of the U-shaped groove, and outer ends thereof are connected to the spring fixing hole 9-3 on the flapper 9. When the flapper 9 is pressed by an external force, the flapper moves along the flapper positioning grooves 8-5 into the U-shaped groove, and at this time, the return springs 4 are pressed and deformed. When the external force is released, the return springs 4 recover the deformation, pushing the flapper 9 to reset.

Figure 13A:
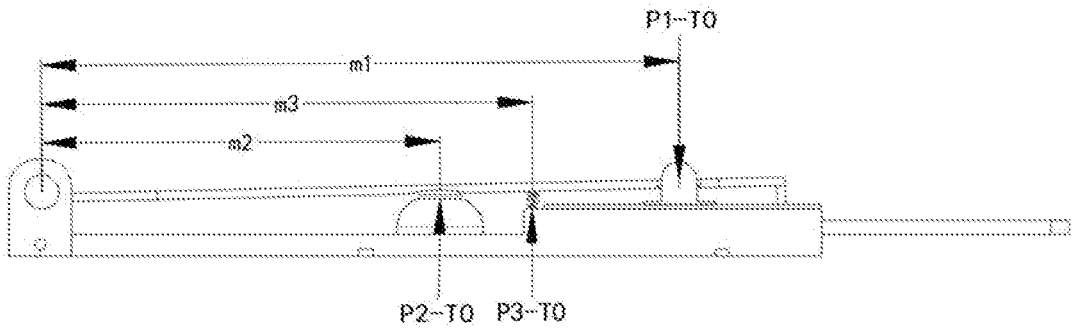
FIG. 13(*a*) is a force analysis diagram of the locking hook plate at a first stage in the operating principle of the automatic falling-off device for the self-sinking and floating type profiling float diversion shell according to an embodiment of the present invention.
Figure 13B:
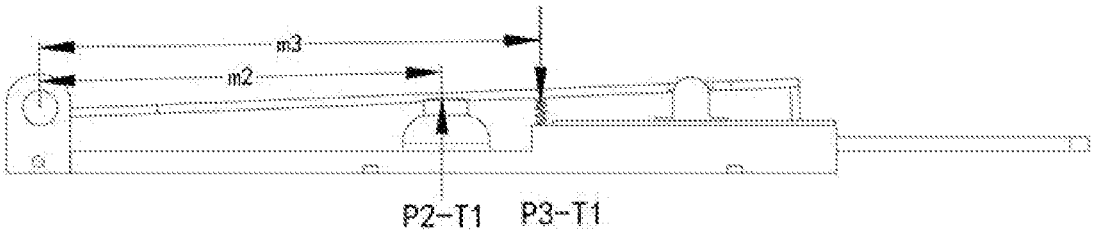
Figure 13C:
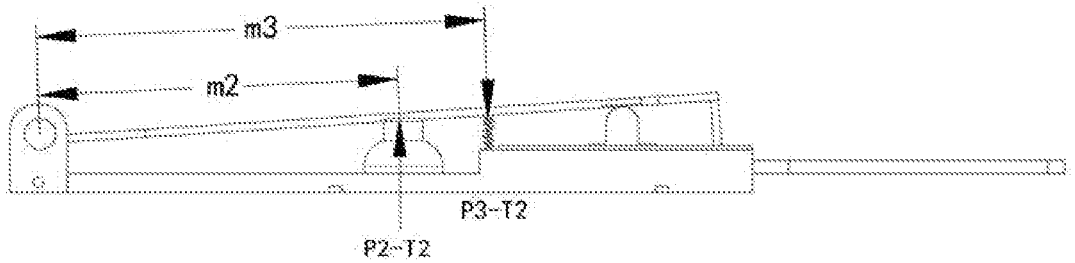

The automatic falling-off device for the self-sinking and floating type profiling float diversion shell of the present invention has the following operating principle and process: in the process of underwater delivery of the self-sinking and floating type profiling float (ARGO), in order to launch successfully, a diversion shell needs to be mounted outside the float. When the launch is completed, the float starts to perform profiling. In the process of profiling, the presence of the diversion shell is not required, and the diversion shell needs to be removed. The automatic falling-off device of the present invention can effectively realize automatic disengaging and falling-off of the diversion shell. In the process of horizontally loading and transporting the float, the first half shell 11 and the second half shell 13 are butted together, the locking hook plate 2 is closely adhered to the base 8, the locking hook 2-5 passes through the locking ring 5-2 on the locking core plate 5 and enters the locking hook groove 8-4, at this time, the limiting airbag 6 is inflated to the inside as an internal pressure is greater than an external pressure, the limiting airbag 6 is clamped into the positioning groove 2-4 of the locking hook plate 2 to limit the locking hook plate 2 so that the locking hook plate cannot move, the locking hook plate 2 and the locking core plate 5 are in a locked state, and the contact end face 5-1 of the locking core plate 5 is in contact with the flapper 9, and presses the flapper 9 to move inwards so that the return springs 4 are in a compressed state. The first half shell 11 and the second half shell 13 form a complete diversion shell which encloses the ARGO float. As shown in FIG. 13(*a*), in an initial state, the buoyancy airbags 7 are in a natural inflated state, an initial pressure inside the buoyancy airbags 7 is set as P2−T0, an initial pressure inside the limiting airbag 6 is set as P1−T0, a tension of the limit spring 3 is set as P3−T0, the limit spring 3 is in a slightly compressed state, m1, m2 and m3 are moments of the limiting airbag 6, the buoyancy airbags 7 and the limit spring 3 respectively, and T0, T1 and T2 represent a first stage, a second stage and a third stage respectively, so that equilibrium of moments is satisfied:

$$P1-T0*m1=P3-T0*m3+P2-T0*m2.$$

As a carrier sinks, the buoyancy airbags 7 are deflated, and at this time, the locking hook plate 2 is subject to the tension of the limit spring 3 and limiting action of the limiting airbag 6, so that the locking hook plate 2 does not disengage from the locking core plate 5. As the carrier moves downwards, the limiting airbag 6 is deflated under the action of water pressure, and disengages from the positioning groove 2-4, so that the limiting action on the locking hook plate 2 disappears, and the locking hook plate 2 moves upwards by a certain distance under a thrust action of the limit spring 3, so that the locking hook 2-5 disengages from the locking hook groove 8-4, but can still hook the locking core plate 2, thus performing locking. As shown in FIG. 13(*b*), the buoyancy airbags 7 are pressed by water and no longer exert the thrust action on the locking hook plate 2, satisfying the equilibrium of moments:

$$P3-T1*m3=P2-T1*m2.$$

When the float runs to a specified underwater depth, the carrier releases the ARGO float, and at this time, the ARGO float begins to float upwards according to its own mode; in the process of floating, as the water pressure decreases, the buoyancy airbags 7 are inflated, pushing the locking hook plate 2 to continue to move upwards. When the ARGO float approaches the water surface, the thrust of the buoyancy airbags 7 increases, overcoming tension moment of the limit spring 3, and detaching the locking hook 2-5 of the locking hook plate 2 from the locking core plate 5, as shown in FIG. 13(*c*), satisfying the moment formula:

$$P3-T2*m3<P2-T2*m2.$$

At this time, the pressing action of the locking core plate 5 on the flapper 9 disappears, and under an elastic force of the return springs 4, the flapper 9 is reset, and the locking core plate 5 is ejected outwards, so that the first half shell 11 and the second half shell 13 of the diversion shell are separated, and the diversion shell falls off automatically after disengaging, and the underwater fixed-depth delivery work is completed. Thereafter, the ARGO float completes the profiling independently.

Figure 12:
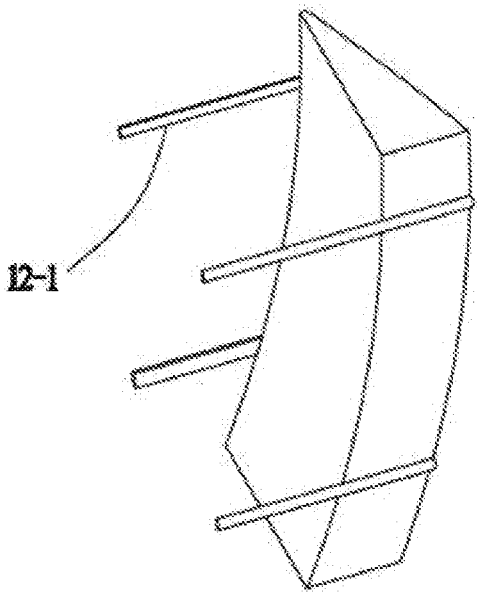
FIG. 12 is a structural diagram of an end cover.

Embodiment 2. This embodiment provides a diversion shell which can be added to a self-sinking and floating type profiling float or other underwater equipment that requires a diversion shell. As shown in FIG. 1, the diversion shell comprises a first half shell 11 and a second half shell 13, and the first half shell 11 and the second half shell 13 are identical axial split structures. A groove is made at a split section position of the second half shell 13, the automatic falling-off device according to embodiment 1 (except for the locking core plate) is mounted in the groove, a hole is cut on a split section of the first half shell 11, a locking core plate in the automatic falling-off device is mounted in the hole, a front end of the locking core plate 5 protrudes from the split section, and a protruding portion enters the second half shell 13 and fits with the locking hook plate 2 for locking. The groove on the second half shell 13 is closed by an end cover 12. As shown in FIG. 12, the end cover 12 is provided with a fixing post 12-1, a corresponding fixing hole is provided in the groove, and the end cover 12 can be fastened to the groove by pressing the fixing post 12-1 of the end cover 12 against the fixing hole in the groove. It should be noted that sufficient space is reserved between the end cover 12 and the locking hook plate 2 to provide clearance for upward movement of the locking hook plate upon unhooking. In some embodiments of the present invention, two or more sets of automatic falling-off devices may be arranged symmetrically along the diversion shell.

What is claimed is:

1. An automatic falling-off device for a self-sinking and floating type profiling float diversion shell, comprising a locking device and an unhooking device; the locking device comprising a locking hook plate and a locking core plate; wherein the locking hook plate is arranged on one half diversion shell, and the locking core plate is fixed on another half diversion shell; a locking hook at a front end of the locking hook plate fits with a locking ring at a front end of the locking core plate for locking; the unhooking device comprises a base and a buoyancy airbag; the base is provided below the locking hook plate, and the buoyancy airbag is mounted between the base and the locking hook plate; when the buoyancy airbag is inflated, the locking hook plate is driven to move upwards to release the locking core plate, and then cause the diversion shell to disengage and fall off; a limiting airbag is provided on the base; positioning grooves are provided on both sides of the locking hook plate; the limiting airbag fits with the positioning grooves, and when the limiting airbag is inflated, the locking hook plate is limited to maintain a locked state; and a limit spring is provided between the base and the locking hook plate.

2. The automatic falling-off device for a self-sinking and floating type profiling float diversion shell according to claim 1, wherein a front end of the base is provided with a locking hook groove in fit with the locking hook of the locking hook plate.

3. The automatic falling-off device for a self-sinking and floating type profiling float diversion shell according to claim 1, wherein a return spring is provided on the base, an inner end of the return spring is fixed, and an outer end thereof is connected to a flapper.

4. The automatic falling-off device for a self-sinking and floating type profiling float diversion shell according to claim 1, wherein the one half diversion shell and the other half diversion shell are symmetrical.

* * * * *